United States Patent [19]

Orii et al.

[11] 4,162,717

[45] Jul. 31, 1979

[54] ESCAPE DEVICE

[75] Inventors: Katsuo Orii; Haruo Fushima, both of Sagamihara, Japan

[73] Assignee: Mitsubishi Denki Kabushiki Kaisha, Tokyo, Japan

[21] Appl. No.: 852,499

[22] Filed: Nov. 17, 1977

[30] Foreign Application Priority Data

| | | | |
|---|---|---|---|
| Nov. 29, 1976 | [JP] | Japan | 51-143102 |
| Nov. 29, 1976 | [JP] | Japan | 51-143107 |
| Dec. 15, 1976 | [JP] | Japan | 51-151387 |

[51] Int. Cl.[2] ..... A62B 1/20

[52] U.S. Cl. ..... 182/48; 182/70

[58] Field of Search ..... 182/48, 49, 70, 71–75; 193/25 R, 25 C

[56] References Cited

U.S. PATENT DOCUMENTS 3,301,347 1/1967 Saita ..... 182/48

*Primary Examiner*—Reinaldo P. Machado

*Attorney, Agent, or Firm*—Oblon, Fisher, Spivak, McClelland & Maier

[57] ABSTRACT

A fire escape comprises an escape device, a hardware which is expandable or foldable and hangs the escape device therefrom, a storage container for storing or accommodating the escape device and the hardware, and a brace frame which has the hardware provided in the storage container so as to be movable vertically from the inside of the storage container. With raising of the brace frame, a part of the escape device is thrown out and down from the storage container. The falling force of the escape device partly thrown out is used to pull out the remaining escape device and to deploy the hardware.

5 Claims, 14 Drawing Figures

FIG. 12
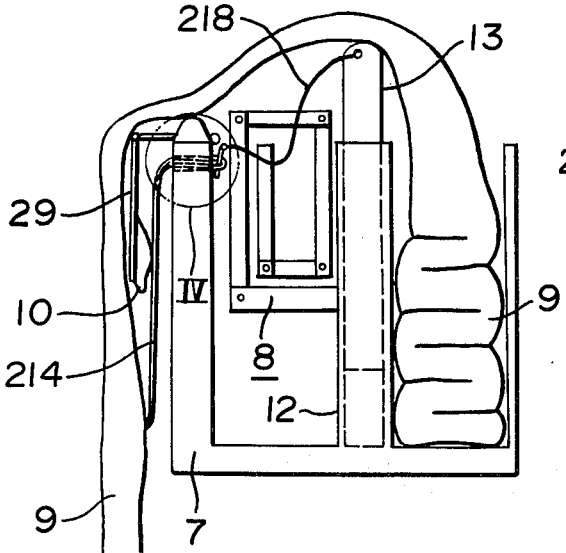
FIG. 14
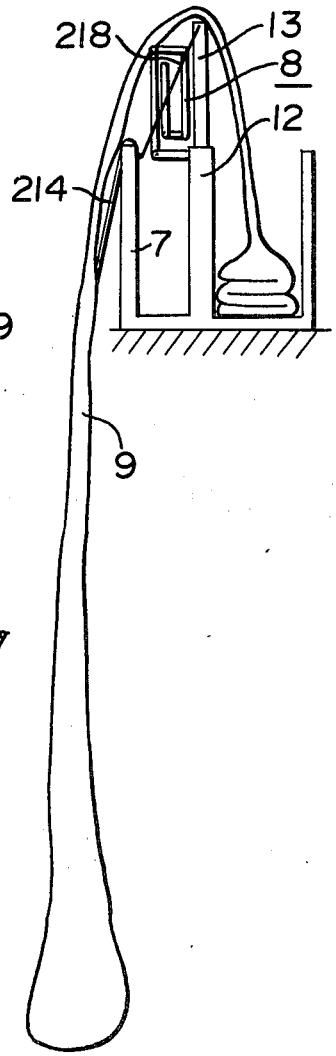
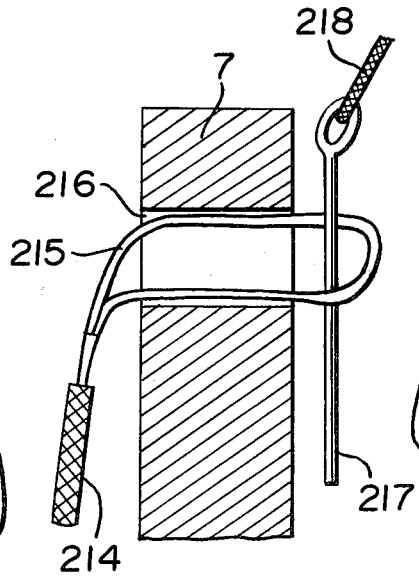
FIG. 13

ESCAPE DEVICE

BACKGROUND OF THE INVENTION

1. Field of the Invention

The present invention relates to a fire escape and more particularly, to a system for throwing out an escape means such as an escape chute to the outside of a building.

2. Description of the Prior Art

By convention, when an escape means such as the escape chute is actually used, a storage container with caster attached thereto is moved to one side, the door of the storage container is opened to the same side, the hardware or the escape means such as the escape chute is lifted by hand, and by depicting a semicircle motion thereof, to be thrown down outside the window (room). However, this conventional system is ineffective when persons must rush thereto and execute such a series of steps; to move the storage container, or to open the door to this side, to lift the hardware or escape chute, and to throw out the escape chute or the like from one side to the outside of the window by depicting a semicircle motion. The expensively installed fire escape is useless, casualties due to fire or smoke may result.

In another conventional system, with respect to the throwing of the escape means such as the escape chute, the hardware is of a foldable structure with the top end connected to the upper end of the escape chute. The escape chute is lifted by hand and thrown out to the outside of the building. Then, the weight of the hardware rotates the hardware itself about the upper part thereof to stretch it outside the building. This conventional system, however, suffers from some problems: the hardware sometimes is insufficiently moved or thrown out of the building and this insufficiency must be offset by raising the hardware by hand. The raising by hand is very difficult when the building is high because the hardware used is strong and bulky. With an intention of compensating for the resultant insufficient depolyment of the hardware, if the number of folding portions is increased or the folding frame is elongated, the deployment of the hardware is more difficult. Further, when the building has a rough wall due to crack or the like below the floor with the escape chute installed, it prevents a smooth descending of the chute or it provides disturbances such as abraision or resistive contact to the descent of the chute. This considerably hinders the proper function of the escape means such as the escape chute.

SUMMARY OF THE INVENTION

Accordingly, the primary object of the invention is to provide a fire escape with a simple construction, with a view to eliminating the above-mentioned shortcomings of the conventional ones of this sort.

According to the invention, there is provided a fire escape which comprises an escape means, a hardware which is expandable or foldable and hangs the escape means therefrom, a storage container for storing or accommodating the escape means and the hardware, and a brace frame which holds the hardware provided in the storage container so as to be movable vertically from the inside of the storage container. With the raising of the brace frame, a part of the escape means is thrown out and down from the storage container. The falling force of the escape means partly thrown out is used to pull out the remaining escape means and to deploy the hardware.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 12 illustrates in a side view a state where a part of the escape chute is thrown down, illustrating still another embodiment of the invention, as of FIG. 7;

FIG. 13 is an enlarged view of the portion of FIG. 12 indicated by IV; and

FIG. 14 is a side view of an embodiment of the invention illustrating the operation thereof, as of FIG. 12.

DESCRIPTION OF THE PREFERRED EMBODIMENTS

Reference will be made to drawings illustrating an embodiment of the invention, wherein like numerals designate identical or corresponding parts throughout the several views.

Figure 1:
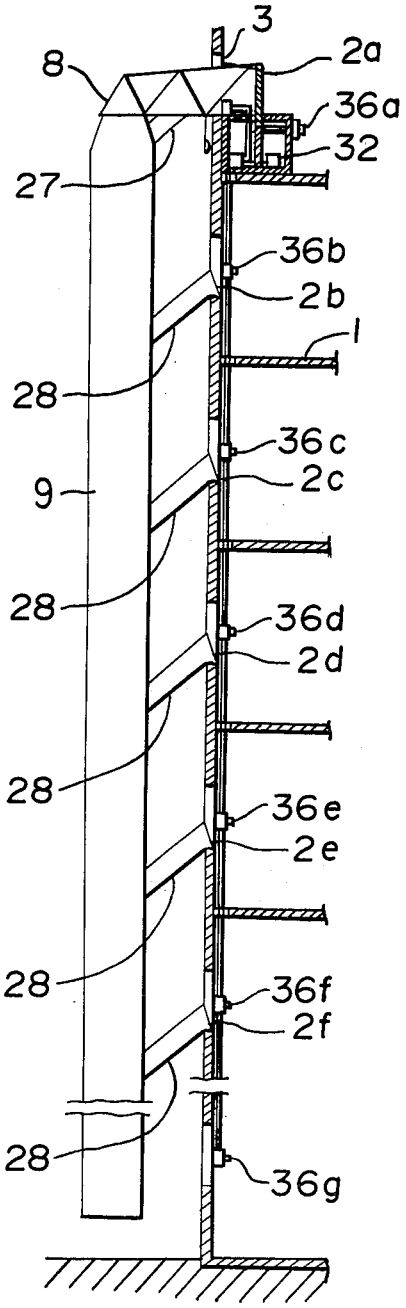
FIG. 1 schematically illustrates the deployment of an embodiment of a fire escape according to the invention.
Figure 2:
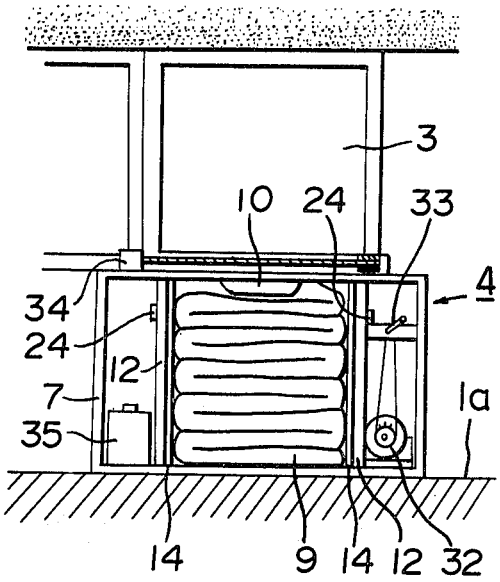
FIG. 2 shows a front view of the fire escape of the invention, with removal of the outer wall thereof for illustrating the storage state in a storage container.
Figure 3:
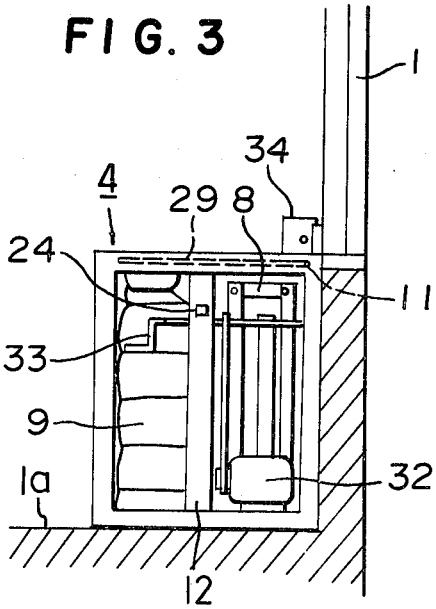
FIG. 3 shows a side view of the same.
Figure 4:
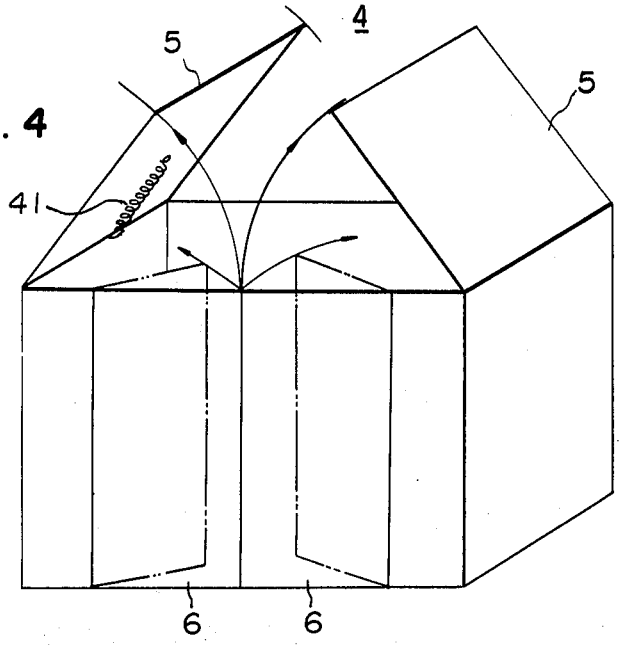
FIG. 4 is a perspective view of the storage container, illustrating opening of its covers and doors.

In FIGS. 1 to 4, reference numeral (1) designates a multifloor building at which a fire escape according to the invention is installed. Reference numerals (2*a*), (2*b*), (2*c*) . . . each designate an escape exit formed in the outer wall surface of each floor of the building, the exit also serving as a window. Numeral (3) represents a window formed at the escape exit (2*a*) on the housetop. (4) is a storage container of the fire escape installed on a floor (1*a*) below the window. As best illustrated in FIG. 4, the storage container is provided at its upper surface with a couple of right and left covers (5) and (5) being both turnable upwardly as shown, and at the front with a couple of right and left doors (6) and (6) being both turnable inwardly. (7) is a frame member framing the storage container (4). A hardware (8) of foldable type structure is stored in the storage container (4), being folded in a normal condition. When in use, it raises up to the escape exit (2*a*) and projects horizontally and outwardly through the escape exit to the outside of the building. The detailedconstruction thereof will be referred to later. An escape chute designated by reference numeral (9) is folded and stored in the storage container (4) in a normal condition and, in use, is hanged by and from the hardware (8) outside the building. The upper end of the escape chute is secured onto the extreme end of the hardware. A basket designated by (10) is fixed at one end on the frame member (7) of the storage container (4) and turnable about an axis (11). In a normal condition, it is accommodated in the storage container (4) and, with raising of the hardware (8), it projects out to the outside of the building and then hangs down. Also in the normal condition, the lower end of the escape chute (9) is placed on the basket.

Figure 5:
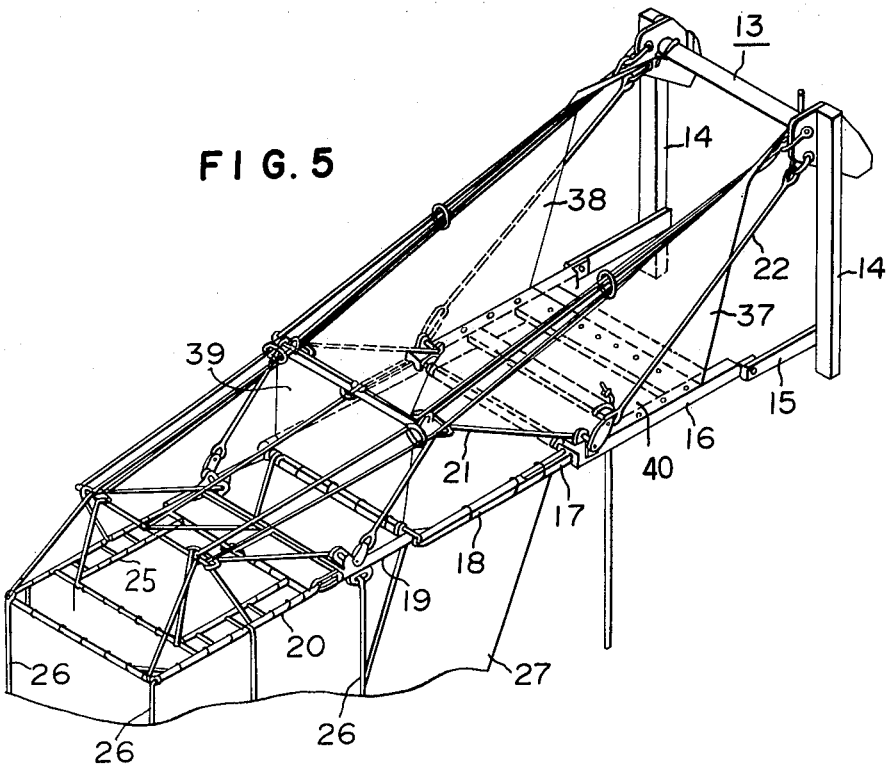
FIG. 5 is a perspective view for illustrating a deployment of a hardware.
Figure 6:
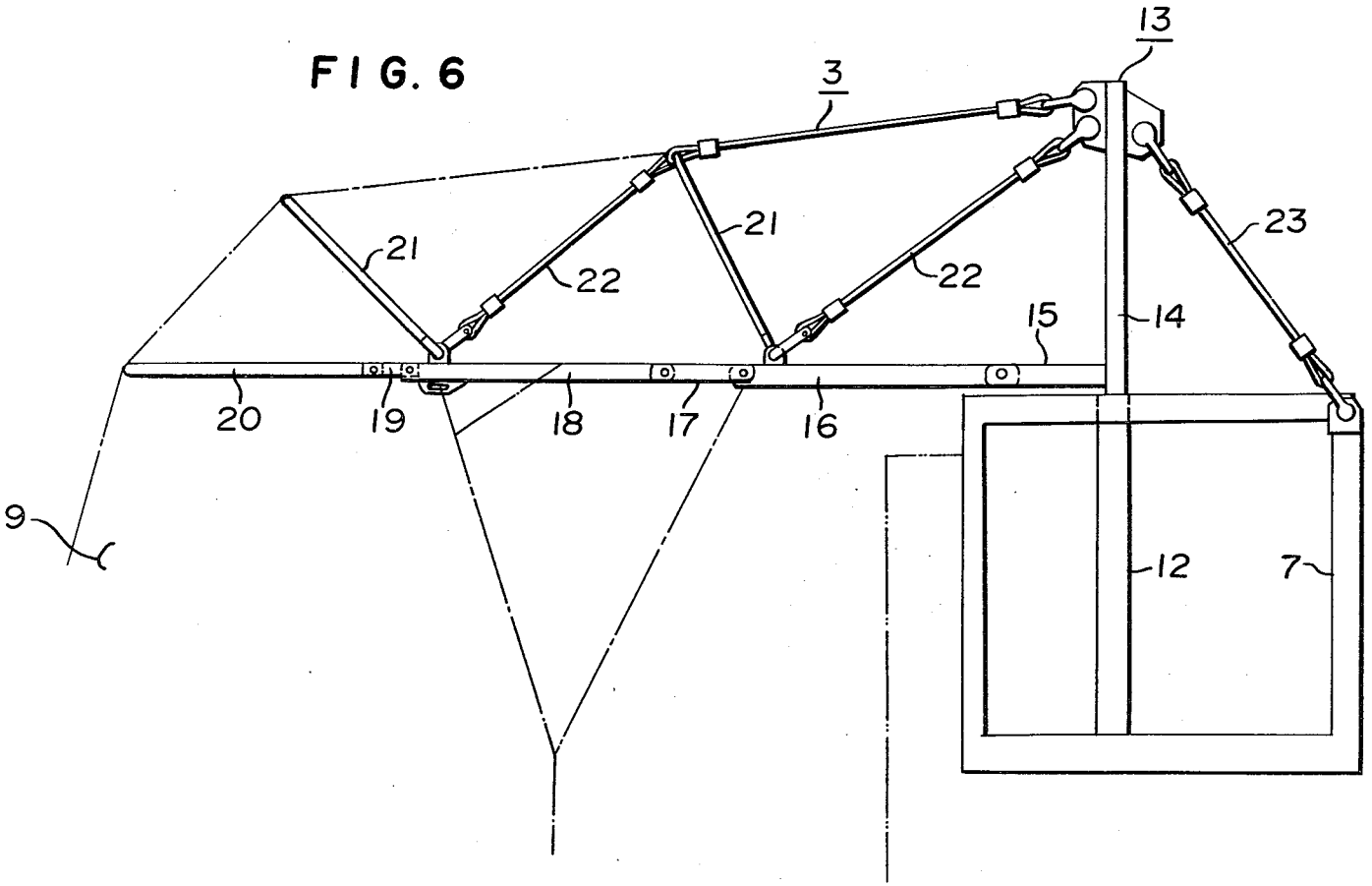
FIG. 6 is a side view of the same.
Figure 7:
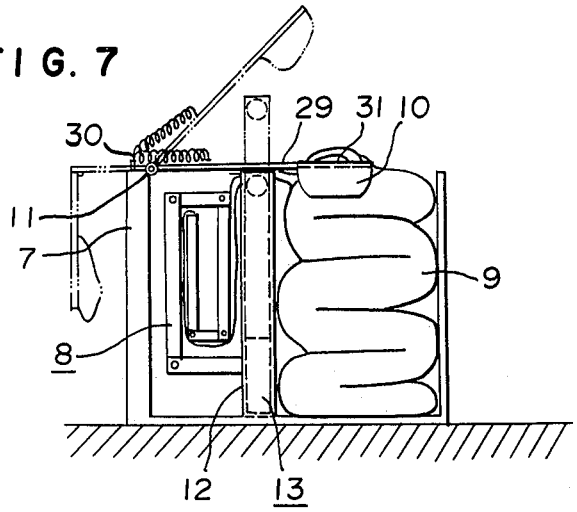
FIG. 7 and FIG. 8 are side views for illustrating the operation of the hardware.
Figure 8:
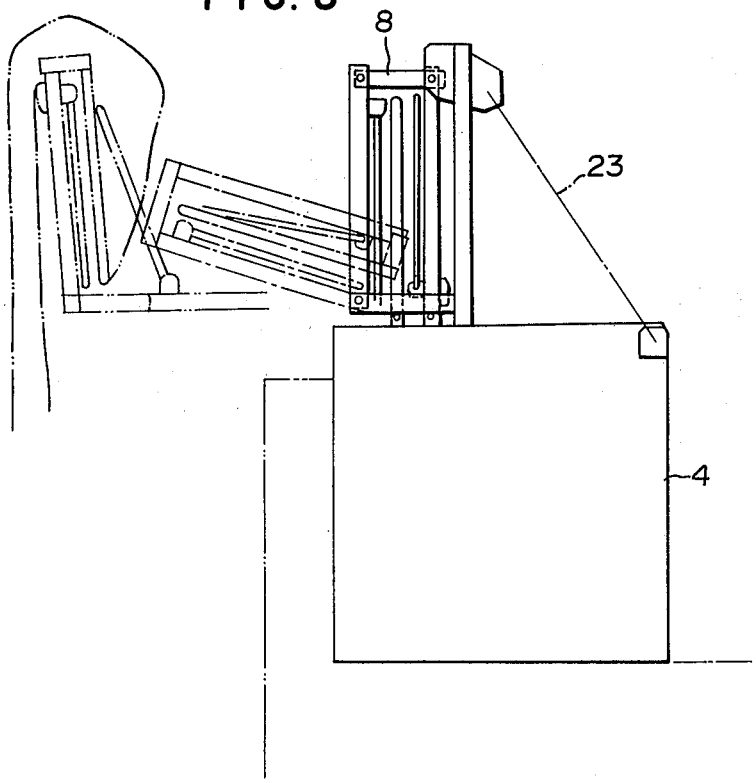

In FIGS. 2 and 3 and FIGS. 5 to 7, numeral (12) is a pair of guide rails vertically extending and facing the frame member (7) in the storage container (4). The guide rails are fixedly disposed therein. A brace member (13) is shaped in a gate and its vertical legs (14) are slidably fitted in the guide rails. Reference numeral (15) designates a couple of horizontal bars horizontally fixed onto the corresponding vertical bars (14) and directed toward the outside of the building. A couple of first link frames (16) are pivoted on the extreme ends of the horizontal bars so as to permit it to be pivotable within a predetermined angular range. Reference numerals (17) to (20) designate second to fifth link frames in which the adjoining ones are pivotally coupled to each other as in the pivotal coupling relation of the first link frame (16) and the horizontal bar (15). In the normal condition, these link frames are folded with respect to the coupling portions and stored in the storage container (4). When being used, they are exposed above the storage container (4) due to raising of the brace frame (13) and successively developed as indicated by continuous, alternate long and short dashes and alternate long and two short dashes lines shown in FIG. 8, and finally developed into a horizontal deployment as shown in FIGS. 5 and 6. Reference numerals (21) and (22) indicate supporting frames and supporting rope respectively, to maintain the link frames (16) to (20) in the horizontal deployment. (23) indicates supporting ropes coupled between the brace frame (13) and the frame member (7)to prevent the raising brace frame (13) from inclining forward. (24) are stoppers mounted on the upper portions of the respective guide rails (12). The brace frame (13) raises to engage the stoppers thereby preventing the brace frames (13) from descending. The hardware (8) is comprised of the above-mentioned components. (25) designates a mounting frame fixed inwardly onto the topmost fifth link frame (20). The upper end of the escape chute (9) is fixed to the mounting frame and the link frame. (26) represents master ropes sewed on the escape chute (9) and tied to the link frame. (27) represents a rectangular tube like upper entrance passage connecting between the link frame and the escape chute (9). (28) designates intermediate entrance passages which are mounted on the peripheral surface of the escape chute (9) with predetermined intervals and, in use, fastened to the corresponding escape entrances of the respective floors. The entrance passages communicate with the falling path of, for example, vertical dropping type or spiral sliding type, escape chute (9).

The escape chute is stored in the storage container (4), being folded as shown in FIGS. 2 and 3 and, in this case, the lower end thereof is put on the basket (10). (29) designates an arm having one end attachedto the basket (10) and the other end rotatably mounted on the frame member (7) by means of a shaft (11). The arm is foldable at the middle. The part of the arm closer to the basket (10) is disposed above the brace frame (13). (30) is representative of a tension spring connected between the portion close to the shaft (11) of the arm (29) and the frame member (7). The tension spring is used to force the arm (29) to turn to the side opposite to the building when the arm (29) is pushed up to a given position by boosting of the brace frame (13), as indicated by an alternate long and two short dashes lines in FIG. 6. A dead weight represented by reference numeral (31) which is coupled with the extreme end of the escape chute (9), facilitates the deployment of the escape chute (9) when the escape chute is thrown down. However, this is not essential to the invention.

In FIG. 2, (32) represents a DC motor installed in the storage container (4). Although not shown here, a known suitable means couples the rotational shaft of the motor with the brace frame (13) in order that the brace frame (13) slides up and down along the guide rails (12). (33) is a manual handle for vertically moving the brace frame (13) by man power. (34) is an automatic window opener and the window driver is mounted at the window of the escape exit on the floor with the storage container (4) installed thereon. This is so designed that a motor, for example, drives the window (3) to open fully, and when the window is fully opened, a detecting switch (not shown) is actuated to stop the opening operation, as in the case of an automatic door. (35) designates a battery serving as a power source of the DC motor (32) and the automatic window opener (34). (36*a*), (36*b*), (36*c*) . . . are start switches which are provided at the storage container (4), the escape exits (2*a*), (2*b*), (2*c*) . . . or a control room of the building. Upon actuation of any one of these switches, the automatic window opener (34) is energized, the detecting switch is actuated after the window is opened, the DC motor (32) is energized, the brace frame (13) starts to raise to reach the given height and then it engages the stoppers (24) and at this time another detecting switch is actuated to deenergize the DC motor (32).

(37), (38) and (39) are guide curtains stretched between the link frames (16) to (18) and the supporting rope (22); (40) is a foot board; (41) is a tension spring for assisting the covers (5) of the storage container (4) to open.

The explanation to follow is the operation of the thus constructed fire escape.

When on fire, earthquake, or escape drill occurs, any one of the starting switches (36*a*), (36*b*), (36*c*) . . . is actuated for use of the fire escape. Upon the actuation of the switch, the automatic window opener (34) operates to open the window (3) at the floor where the fire escape storage container (4) is installed. Opening of the window causes the DC motor (32) to operate so that the brace frame (13) is raised along the guide rail (12). Raising the brace frame pushes up the cover (5) of the storage container (4) to open and at the same time the hardware (8) in folded condition is raised. With raising of the gate shaped brace frame (13), the basket (10) and the arm (29) are both raised and the basket turns about the shaft (11) at the end of the arm. Immediately before the upper limit of the upward movement of the gate shaped brace frame (13), the tension spring (30) becomes effective to make the basket (10) fully turn to the opposite side. At this time, a part (9) of the escape chute or the dead weight (31) are thrown out into a space to pull the remaining escape chute (9) out of the storage container. As the gate shaped brace frame (13) reaches the topmost height, the stopper (24) operates to prevent descent of the brace frame (13) to fix it there. The upper end of the escape chute (9) is connected with the extreme end of the hardware (8) being folded. Accordingly, when the escape chute (9) has completely pulled out, the empty weight of the escape chute additionally serves as a pulling force for the foldable type hardware (8) to pull out at a dash the hardware (8) into its deployment, and the hardware hangs the escape chute (9) therefrom. If it should not operate, the hardware (8) is operated by using the manual handle (33) instead of the motor, thereafter being followed by a similar operation.

Then, the intermediate escape passages (28) are hauled in through the escape windows (2*b*), (2*c*), . . . and fixed at the windows with the result that the fire escape is ready for use. Building occupants enter through the intermmediate escape passage from the escape windows into the escape chute for evacuation. The occupants on the floor having the storage container (4) installed thereon push to open the front doors (6) and enter the escape chute (9) through the storage container (4), the brace frame (13), and the escape exit (27). That is, at this time, the escape chute (9) has been thrown out to the outside of the building and the space for storing or accommodating the folded escape chute (9) has been emply thereby to permit the front doors (6) to be turnable inside.

As seen from the foregoing description, the hardware of the fire escape of the invention is so designed that it never must shift or turn toward the incoming rushed crowd of building occupants. Therefore, when the occupants rush to the through escape window, the escape means such as the escape chute and the like may be smoothly moved to their dropping position thereby permitting a sure deployment thereof and preventing tragic accidents.

In the above-mentioned embodiment, the inward turning of the front doors is so designed as to be locked by accommodation of the escape chute in the storage container. As a matter of course, an additional door locking mechanism may be provided instead of such a locking design.

Figure 9:
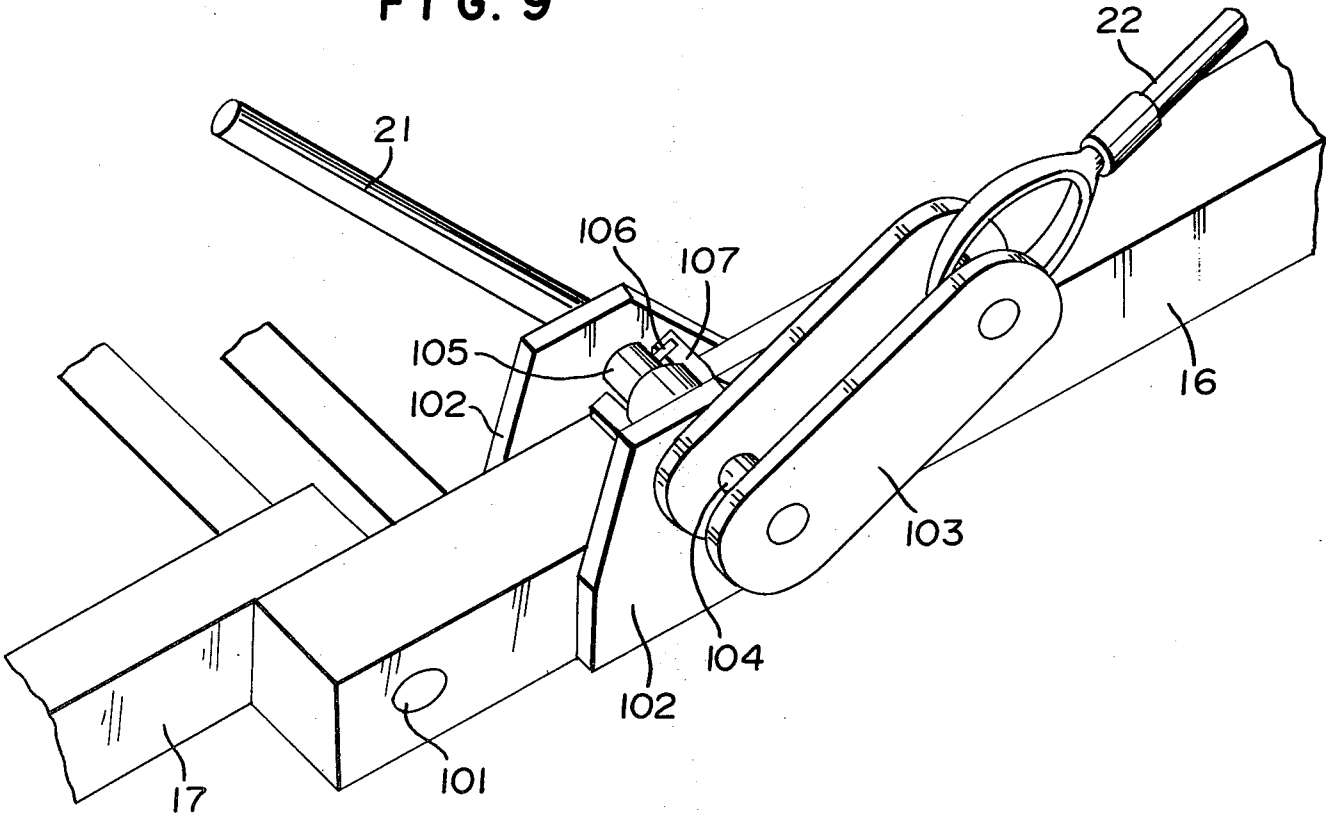
FIG. 9 shows a perspective view illustrating a chief part of another embodiment of the fire escape of the invention.
Figure 10:
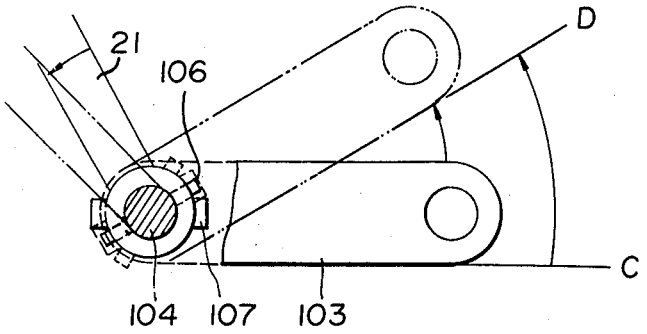
FIG. 10 is a diagram for illustrating the operation of the construction shown in FIG. 9.

Another embodiment of the invention will be given referring to FIGS. 9 to 10 illustrating chief portions of the invention.

This embodiment provides a smooth deployment of a foldable link mechanism of the hardware (8) shown in FIGS. 1 to 8. In FIG. 9, reference numeral (16) designates a first link frame of which one end is pivotally coupled with the horizontal projection bar (15) of the gate shaped brace frame (13) (FIG. 6). Reference numeral (17) is a second link frame pivotally coupled with one end of the first link (16) by means of a shaft (101). Reference numeral (102) is a bearing plate secured onto the first link frame (16) at a more frontal side (closer to the brace frame (13)) than the connection point between it and the second link frame (17). Reference numeral (103) is a couple transfer member secured to a shaft (104) rotatably supported by the bearing plate (102). Reference numeral (22) denotes a supporting rope connected at one end to the couple transfer member (103) and at the other end to the brace frame (13). When the supporting rope (22) is tensioned, the first link frame (16) is horizontally supported. Numeral (21) denotes a supporting frame rotatably mounted to the bearing plate (102). Numeral (105) represents a shaft rotatably coaxially with the shaft (104) and connected to the supporting frame 21, and said shaft (105) is rotatably supported by the bearing plate (102). Numeral (106) is a projection provided normal to the shaft extension (105). Reference numeral (107) is a projection radially projected from the end of the shaft (104) of the couple transfer member (103). When the first link frame (16) rotates to lay in a horizontal posture, the couple transfer member (103) is rotated to a given position by the supporting rope (22) and at this time the projection (107) engages another projection (106) of the supporting frame (21). Succeedingly, rotation of the couple transfer member (103) forces the supporting frame (21) to rotate.

With such a construction, when the link frame of the hardware (8) is deployed following throwing out of the escape chute, the supporting rope (22) pulls up the couple transfer member (103) from C to D in FIG. 10 as the first link frame (16) approaches to the horizontal posture. Accordingly, the shaft (104) rotates to the right in FIG. 10 within the bearing of the bearing plate. With the rotation of the shaft, the projection (107) of the shaft (104) fixed to the couple transfer member (103) comes in contact with the projection (106) of the supporting frame (21) to push the supporting frame. In turn, the frame further pushes the other link frame. This extends the hanging length of the escape chute, thus increasing the weight by its extension. The increased weight cooperates with the inertia developed when the hardware is pushed out to ensure a perfect deployment of the hardware.

As described above, the embodiments shown in FIGS. 9 and 10 are designed such that force is transferred through the engagement of the shaft (104) of the couple transfer member (103) with the shaft extension (105). An alternative of it is shown in FIG. 11.

Figure 11:
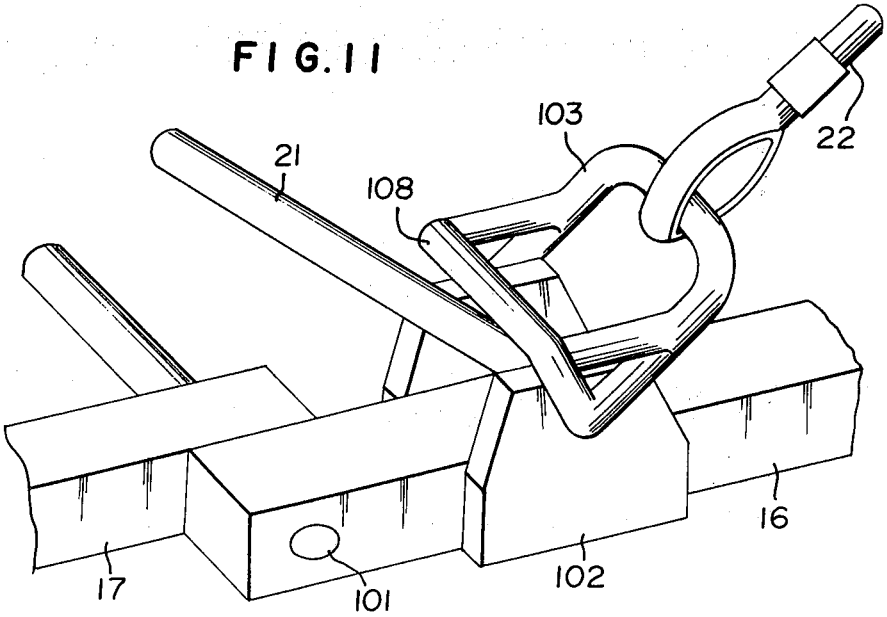
FIG. 11 is a perspective view of another embodiment of the invention, illustrated as of FIG. 9.

As shown in FIG. 11, the couple transfer member (103) is provided with a bridge (108) across the bearing plate (102). In operation, as the couple transfer member (103) rotates, the bridge (108) comes in contact with the lower portion of the supporting frame (21) to push the supporting frame. As easily seen, this example has the same function as of the example referred to FIGS. 9 and 10.

In the above-mentioned embodiments, the supporting rope (22) for supporting horizontally the first link frame (16) drives the couple transfer member (103) which in turn moves the supporting frame (21) to push the remaining link frame. Alternately, the couple transfer member may directly push the remaining link frame.

Another embodiment of the invention will be given with reference to FIGS. 12 to 14.

FIG. 12 shows a side view of the escape chute storage container with removal of the peripheral wall thereof for illustrating a state where a part of the escape chute (9) is dropping while being taken out of the basket (10). FIG. 13 shows an enlarged view of the IV portion of FIG. 12. FIG. 14 is a side view similar to FIG. 12, but illustrates the succeeding phase of the FIG. 12 state where the escape chute (9) is going to be completely pulled out following a temporary stop of the dropping of the escape chute.

The members (7), (8), (9), (10), (12), (13), and (29) are the same as those of in the previous cases so that the explanation related to them will be omitted. In the figures, reference numeral (214) designates a stationary rope or belt secured at one end to the escape chute (9) appropriately above the extreme end thereof by sewing it onto the chute and the other end of the rope is looped. The looped portion of the stationary rope is inserted through a hole (216) formed in the frame (7). Reference numeral (217) is a pin inserted into the loop (215), for fixing the rope within the hole (216) of the frame (7). Numeral (218) is a traction rope or belt connecting at one end to the pin and at the other end to the brace frame (13) or a movable member attached to the brace frame. The traction rope has a length sufficient to pull out of the loop (215) the pin (217) connected to one end of the traction rope (218) when the brace frame (13) reaches the topmost position.

The explanation to follow is the operation of the above-mentioned construction. The escape chute (9), pulled out of the basket (10) during raising of the brace frame (13), continuously and rapidly drops due to its empty weight and the throwing-out force given when it is thrown out. And when the escape chute drops by a given length of the chute, the empty weight of the dropped part of the rope is supported by the stationary rope (214) sewed on the chute at the location appropriately distanced from the extreme end of the escape chute. At this point, the dropping of the escape chute temporarily stops. Under this condition, the brace frame (13) further continues its raising to reach the topmost point. At this time, the traction rope (218) is stretched to take the pin (217) from the loop (215) of one end of the stationary rope and to release the stationary rope from the hole (216). Accordingly, the extreme end of the escape chute further descends. At this time, the descending force of the escape chute pulls the remaining chute from the storage container while at the same time deploys rapidly the hardware, thereby hanging the escape chute (9) therefrom.

Therefore, in raising the brace frame, none of the empty weight of the successively dropped escape chute is exerted on the brace frame but a small force necessary to pull up the escape chute remaining in the storage box is exerted on it.

The beneficial effects resulting from the just-mentioned construction are as follows:

(a) Small is the force necessary to boost the brace frame.

(b) Since the brace frame boosting force is small, the foldable type hardware may be raised together with the brace frame.

(c) The escape chute does not drop at a single stretch to ground and this indicates that pedestrians walking thereunder can afford to perceive the drop of the escape chute, thereby avoiding danger.

In the above-mentioned embodiments, the escape chute was used as escape means; however, a vertical dropping type, a spiral sliding type escape chute and the like may be used instead of it. Further, the escape chute used in the invention is not limited to the chute type as mentioned above, but other suitable type is available, for example, a ladder type means.

It will be understood additionally that means to avoid exertion of the weight of the escape chute on the brace member until the brace frame raises to a given height after the escape chute is thrown out and down during raising of it, is not limited to the one mentioned in this specification, as a matter of course.

What is claimed is:

1. A fire escape comprising an escape means; a hardware which is expandable or foldable and hangs said escape means therefrom; a storage container for storing said escape means and said hardware; and a brace frame which has said hardware provided in said storage container so as to be movable vertically from the inside of said storage container; whereby, with raising of said brace frame, a part of said escape means is thrown out and down from said storage container and the falling force of said escape means partly thrown out is used to pull out said remaining escape means and to deploy said hardware.

2. A fire excape according to claim 1 in which said haredware is of link frame structure is successively foldable in one direction.

3. A fire escape according to claim 1 in which said brace frame is of a gate shape including horizontal and vertical parts, and a basket for accommodating a part of said escaping means is provided at one end of an arm of which the other end is turnably mounted on said storage container and said arm is disposed above said horizontal part of said brace frame.

4. A fire escape according to claim 2, further comprising: a supporting member for keeping said link frame structure horizontal when said link frame is stretched; and a couple transfer member moved by said supporting member; wherein a movement of said couple transfer member up to a given position assists the succeeding link frame to stretch.

5. A fire escape according to claim 1, in which a stationary rope with a given length is fixed at one end on the midway portion of said escape means and releasably coupled at the other end with said storage container, and the coupling of said stationary rope with said storage container is released when said brace frame raises up to a given height.

* * * * *